US006082110A

United States Patent [19]

Rosenblatt

[11] Patent Number: 6,082,110

[45] Date of Patent: Jul. 4, 2000

[54] AUTO-REHEAT TURBINE SYSTEM

[76] Inventor: Joel H. Rosenblatt, Mile Marker 24.5, Royal Palm Plaza, Summerland Key, Fla. 33042

[21] Appl. No.: 09/342,096

[22] Filed: Jun. 29, 1999

[51] Int. Cl.[7] ..... F01K 7/22

[52] U.S. Cl. ..... 60/663; 60/670

[58] Field of Search ..... 60/641.2, 641.5, 60/653, 663, 670

[56] References Cited

U.S. PATENT DOCUMENTS

| | | | |
|---|---|---|---|
| 3,518,830 | 7/1970 | Viscovich et al. | 60/653 X |
| 4,164,848 | 8/1979 | Gilli et al. | 60/653 X |
| 4,386,498 | 6/1983 | Lee et al. . | |
| 4,604,867 | 8/1986 | Kalina . | |
| 4,873,827 | 10/1989 | Hadano et al. | 60/653 X |
| 5,079,922 | 1/1992 | Viscovich et al. . | |
| 5,140,818 | 8/1992 | Silvestri, Jr. et al. . | |
| 5,671,601 | 9/1997 | Bronicki et al. . | |
| 5,793,831 | 8/1998 | Tsiklauri et al. . | |
| 5,850,739 | 12/1998 | Masnoi . | |

*Primary Examiner*—Hoang Nguyen
*Attorney, Agent, or Firm*—Jacobson, Price, Holman & Stern, PLLC

[57] ABSTRACT

An auto-reheat system for use with a steam turbine in which a portion of the heat energy supplied to the turbine from a heat source is directed to an ensuing region of the vapor path where the transiting vapor has expanded to such an extent that it begins to become "wet." The portion of heat energy directed to the ensuing region is delivered concurrently with the supply of heat energy to the admission port of the turbine, permitting a higher temperature to be maintained within the transiting vapor and thereby reducing the quantity of moisture developing in the vapor during the latter stages of the turbine expansion cycle. The result is improved turbine energy output and reduced blade maintenance costs.

11 Claims, 3 Drawing Sheets

AUTO-REHEAT TURBINE SYSTEM

BACKGROUND OF THE INVENTION

1. Field of the Invention

The present invention is related to the field of steam turbine engines and, more particularly, to a system for maintaining the elevated temperature of vapor transiting the turbine path.

2. Description of the Related Art

Typically, in steam turbine systems, as steam expands isentropically across the low pressure range of the turbine cycle prior to reaching its intended exhaust pressure, its thermodynamic state conditions reach a point of crossing the saturation curve of the vapor. The result is the development of "wet" vapor conditions in the expanding steam turbine medium. A "wet" vapor condition is that condition resulting when droplets of liquid phase turbine medium form in the vapor mass undergoing expansion to progressively lower temperature and pressure. The presence of these moisture particles in the vapor stream moving through the turbine impacts the back surfaces of the blading in the turbine, causing both a reduction in the energy delivered to the blading for the purpose of rotating the turbine shaft, i.e., a reduced energy output, and erosion of the blading edges and pitting of the blade surfaces. The combined effects result in both reduced thermodynamic efficiency of the turbine and increased cost of maintenance of the turbine in service.

Historically, efforts to reduce or minimize these unwanted effects have led to development of what has become known as the "reheat" cycle. When the vapor is developed using a boiler, the boiler delivering heat through consumption of one or another type of fuel, it commonly happens that some of the heat generated by consuming the fuel is not completely absorbed by the vaporizing turbine medium. Having delivered the peak temperature available to the water being boiled, additional heat content at a lower temperature remains available in the boiler passages. After a portion of the higher temperature stages of the turbine path have been traversed in the turbine, the expanding vapor is removed from the turbine, returned to the boiler, and reheated by that source of additional external heat remaining in the boiler. The boiler section providing that lower temperature heat for subsequent addition to the expanding vapor is commonly referred to as the boiler "economizer". In the process, the vapor acquires a higher temperature, at its now reduced pressure, to recreate a superheated condition at its new combination of pressure and temperature. Reintroduced to the turbine path, the reheated vapor moves the expansion path away from the saturation curve, thereby eliminating formation of wet vapor conditions for an ensuing portion of the expansion path.

With steam as the thermodynamic medium expanding in the turbine, eventually a limitation is reached on the ability to expand the steam further due to inability to maintain a high enough vacuum condition to provide the lowest exhaust pressure consonant with the lowest ambient temperature to effect condensation of the exhaust. Current steam turbine practice is limited to a minimum exhaust pressure of about 1.5 ins. Hgabs (3.81 cm Hgabs). This limit is created not by virtue of an inability to secure a lower ambient temperature to effect condensation of the exhaust, but by an inability to maintain that high a vacuum in the condenser. At that very low exhaust pressure, the saturation temperature remains slightly above 91° F. (32.780° C.). Despite the existence of external ambient site cooling conditions being commonly available at much lower temperatures than that, it often happens in American practice that utility company power plants are forced to raise the exhaust pressure in the summer time by an amount sufficient to result in a differing "summer rating" and "winter rating" for their reliable power delivery capacity. Occurrence of a lower temperature in the exhaust conditions as minimum pressure is reached further exacerbates the probability of occurrence of excessive wet vapor conditions before the intended turbine exhaust pressure is attained.

In many applications, where access to the external heat source vaporizing the medium does not permit returning the vapor to its external heat source, the opportunity to institute a reheat cycle may not be available. Damaging moisture content is experienced at higher pressures, or acceptance of higher exhaust pressures with attendant lower thermodynamic efficiencies is forced upon the operator.

Moisture developing in the expansion path is particularly common in power plant facilities operating in geothermal power developments where the geothermal resource being tapped is from a liquid dominated reservoir. The very process of flashing the liquid to yield a vapor fraction produces both the vapor desired to be supplied to the turbine, and a quantity of hot liquid phase brine accompanying the vapor, both at saturation conditions for the temperature and pressure at which the flash occurs. The characteristic saturation curve of steam indicates that after starting from a saturated condition at the turbine admission port, any amount of expansion along an isentropic path through the turbine immediately crosses the saturation curve and enters a wet vapor condition, and becomes progressively wetter as expansion proceeds.

Additionally, at the same time that the steam fraction is released as a vapor, the residual liquid geothermal brine, also at saturation temperature and pressure, becomes a waste stream for the facility that needs to be disposed of by re-injection in the well field. In general, most geothermal brines contain dissolved minerals and other pollutants which impose a minimum temperature at which the brine liquid residue must be re-injected to avoid releasing the dissolved pollutants from the fluid and causing damaging deposits as the solutes separate from the liquid. As an example, it may be necessary to reinject the brine at a temperature of not less than 180° F. (82.2° C.). With the geothermal brine at a starting temperature of 304° F., the prior art process obligated the operation to waste some two-thirds of the heat energy contained in the brine delivered to the surface plant from the well field.

SUMMARY OF THE INVENTION

In view of the foregoing, one object of the present invention is to provide a system for adding additional heat energy to the vapor flow without a reheat cycle.

Another object of the invention is to supply reheat to the vapor using the original superheated vapor input to the turbine.

An additional object of the invention is to increase the thermodynamic efficiency of the turbine by reducing moisture particles in the vapor stream.

A further object of the invention is to reduce maintenance costs for the turbine by reducing moisture damage to the blades.

A still further object of the invention is to use the hot liquid brine byproduct of flashing a geothermal resource to supply additional heat energy to the vapor flow transiting the turbine.

In accordance with this and other objects, the auto-reheat system of the present invention provides means for adding additional heat energy to the flowing thermodynamic medium traversing the internal path within a Rankine cycle turbine, without having to remove the medium from the turbine for the purpose of adding heat energy to its mass flow and then returning it for further expansion. The addition of heat energy to the flowing thermodynamic medium moves the expansion path away from the saturation curve, preventing or at least significantly deferring the development of wet vapor conditions in the expansion path.

The present invention can be embodied by extracting a portion of the superheated vapor entering the turbine to provide heat energy to a zone of the turbine further along the expansion path. The extracted portion may be injected back into the vapor flow or may be used to fill an annular jacket around the body of the turbine in the appropriate area of the expansion path where heat energy is needed to counter moisture development. The present invention may also be embodied for use in connection with geothermal power development wherein the hot liquid brine that naturally remains after flashing a geothermal resource to produce a vapor fraction is used to fill a jacket surrounding the turbine body to impart heat thereto. In each of these embodiments, the present invention affords the advantage of increasing the temperature of the vapor mass flow without the need for removing the flowing vapor to add supplemental heat thereto before returning the vapor to the turbine. Accordingly, the present invention maximizes the benefit gained from the heat energy already available on a nearly simultaneous basis with minimal routing requirements.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
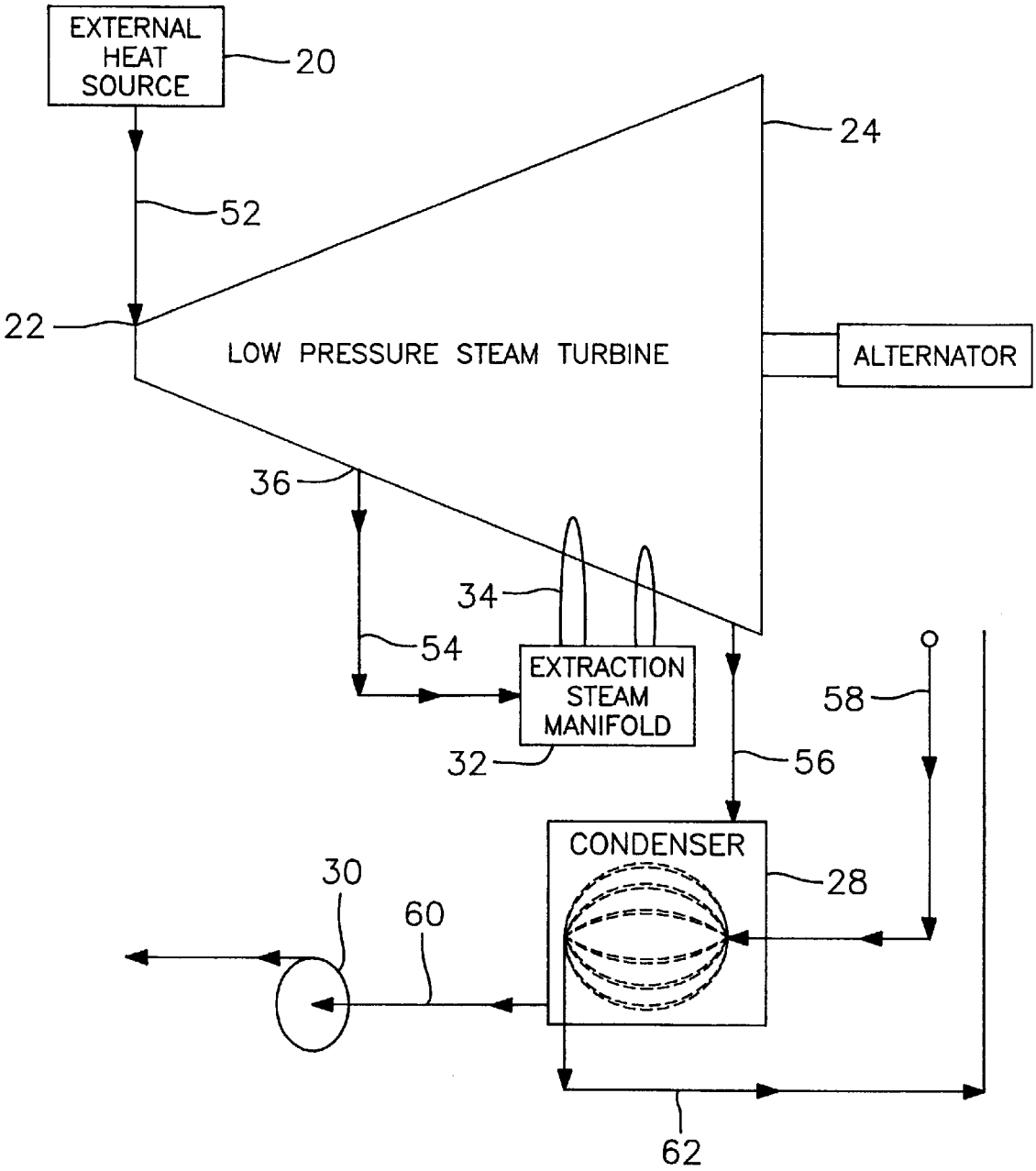
FIG. 1 illustrates a first embodiment of the present invention as an auto-reheat injection steam turbine system.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention is for an auto-reheat system for use with a low pressure steam turbine, namely a Rankine cycle turbine engine having an admission port to accept entry of high temperature high pressure vapor, and being equipped with the necessary blading and stages to permit isentropic expansion of the vapor on a main path therethrough to an exit port at a lower temperature and lower pressure. The Rankine cycle turbine engine also includes all necessary throttling and control devices to permit safe control of the operation of the engine to deliver rotating output shaft power for use.

As used herein, "high temperature high pressure" is meant to refer to those temperatures and pressures known by persons of skill in the art to be appropriate for input to and efficient operation of a Rankine cycle turbine engine. By "lower temperature and lower pressure" is meant those temperatures and pressures less than "high temperature high pressure" and, in particular, those temperatures and pressures at which moisture begins or becomes likely to develop along the expanding vapor path within the turbine.

The high temperature high pressure vapor is delivered to the turbine admission port from an external heat source and is commonly in a superheated condition. Beginning in the entry zone of the turbine, the high temperature high pressure vapor is capable of being expanded along a portion of its intended isentropic, or main, path through the turbine before it crosses the saturation curve to enter a region where it becomes progressively more "wet" as further expansion occurs. Having entered such a "wet" vapor region, its continued expansion leads to a condition of becoming dangerously "wet", i.e., progressively less efficient thermodynamically, and progressively more erosive and damaging in its impact on the turbine blading. The wet vapor region occurs in what is referred to herein as a "subsequent zone" of the main expansion path through the turbine, the subsequent zone lying beyond the entry zone with reference to the admission port. Such wet vapor develops concurrently with the time that expansion of the superheated vapor is progressing through the entry zone of the turbine.

With the present invention it is possible to extract a portion of the superheated vapor from the cycle path in the entry zone where the vapor is in the high temperature high pressure condition, and use the extracted portion to heat an ensuing region of the vapor path in the vicinity of the subsequent zone, where excessive moisture occurrence is having its more deleterious effect. The sum of the heat energy content of the extracted portion of the superheated vapor and that of the wet vapor being conjoined can create a dry vapor, or at least a less wet and less damaging vapor, as exhaust conditions are approached.

According to the present invention, the auto-reheat system for a steam turbine comprises means for directing a portion of the heat energy, obtained from the heat source, away from the main path, as well as means for delivering the portion of heat energy directed away from the main path to the subsequent zone within the turbine expansion cycle where the transiting vapor has reached a lower temperature and lower pressure. The heat energy delivered to the subsequent zone is provided concurrently with delivery of the high temperature high pressure vapor entering the turbine from the heat source, permitting maintenance of a higher temperature within the vapor as it transits the turbine path by supplying supplemental heat energy to the flowing thermodynamic medium within. Through maintenance of a higher temperature within the vapor flow, the present invention reduces the quantity of moisture developing in the expanding turbine vapor flow and, hence, minimizes or eliminates the damaging effects to the turbine blades attributable to such moisture.

In all cases of the following examples of the concept invention, once the external heat energy source has delivered its heat energy to the circulating turbine medium, there is no need to return it to an external heat energy source for further heat energy input. The heat energy, once received from the external source, is internally contained in the medium within which the heat energy is conveyed; reheat occurs "automatically" from the turbine medium source already containing the needed additional heat energy content. In each of the following examples, means are shown permitting reheat energy to be supplied to the turbine medium while it is in transit through the turbine, i.e., without withdrawing the expanding turbine medium for the purpose of adding additional heat energy thereto.

FIG. 1 illustrates a first embodiment of the invention. In this embodiment, means for directing is embodied as an extraction port 36 and a conduit 54, and means for delivering is embodied as a manifold 32 and a plurality of injectors 34. The extraction port 36 is located on a side of the turbine sufficiently near the admission port to ensure sufficiently high temperature and pressure remain in the vapor being extracted. The manifold 32 is mounted on the turbine body generally at a point closer to the exit port than to the admission port. The manifold supports the plurality of injectors 34, which are mounted on the perimeter of the turbine housing. The conduit 54 connects the extraction port 36 to the manifold 32.

Steam is produced in an external heat source 20 and passed to the turbine 24 through a steam supply conduit 52. Steam enters the turbine 24 through an admission port 22, where it passes into the entry zone of the turbine. A portion of superheated steam from the entry zone is extracted through the extraction port 36 and supplied through the conduit 54 to the high temperature, high pressure manifold 32 mounted on the turbine body. From the manifold, the vapor is reintroduced, through the plurality of injectors 34, into the expanding turbine vapor path at selected points farther along the path, namely in the subsequent zone within the turbine where the transiting vapor is becoming undesirably "wet". The extracted steam is reintroduced in quantities and at pressures such that the ensuing mixture occurring in the expanding vapor path in the subsequent zone results in a dry vapor condition (or at least a far less "wet" condition with far more tolerable conditions for the turbine blading).

There is a design engineering trade-off encountered in determining the optimal amount of steam to extract, i.e., a trade-off between the loss of high temperature turbine medium for delivering power in the upper end of the turbine, against the amount of wet vapor condition relieved through diverting such high temperature turbine medium to elevate the temperature of a cooler segment of the path farther along its route of travel. To the extent that some of that heating accomplishes the purpose of vaporizing what had become moisture content in the wet region, that re-vaporized portion also contributes to an increase in the potential energy being delivered to the rotating shaft as a result of the blading being traversed by dryer vapor.

Steam exhaust 56, typically at a pressure of about 1.5 ins. Hgabs (3.81 cm Hgabs), is routed from the turbine 24 to a condenser 28. Water from an ambient cooling water supply 58 is also routed to the condenser 28. A cooling water return 62 directs water back from the condenser 28 to a cooling tower. Liquid phase condensate 60 is routed to a condensate return pump 30.

Figure 2:
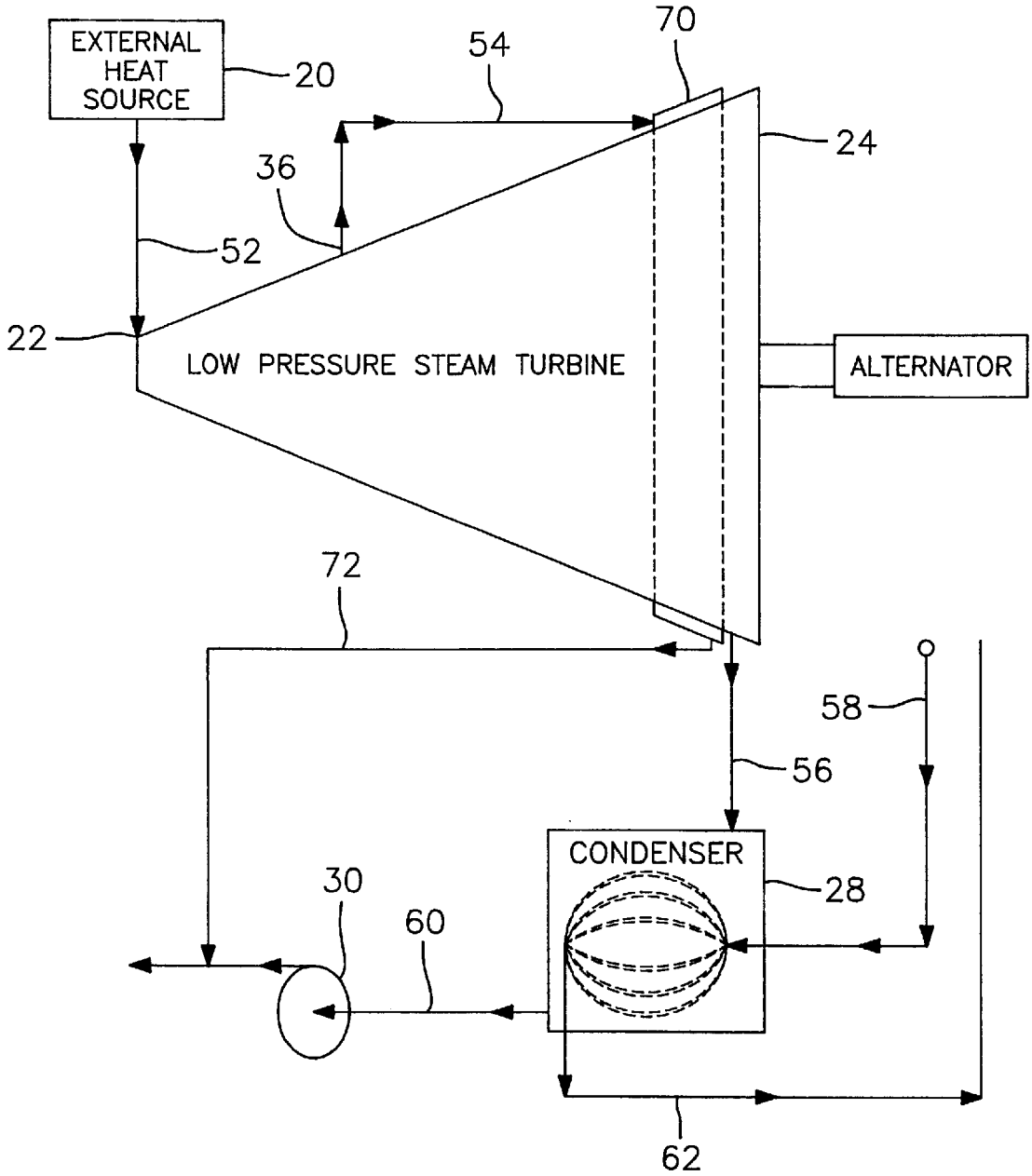
FIG. 2 illustrates a second embodiment of the present invention as an auto-reheat jacketed steam turbine system.

FIG. 2 illustrates a second embodiment of the invention. Means for directing is embodied as an extraction port 36 and a conduit 54. Means for delivering is embodied as an external annular jacket 70. The extraction port 36 is located on a side of the turbine, at a distance close enough to the admission port to ensure a sufficiently high temperature and pressure remain in the vapor being extracted. The external jacket 70, mounted on an outer surface of the turbine body, surrounds or is adjacent at least part of the subsequent zone of the expansion path which is in the process of becoming undesirably "wet". In encircling the turbine, the external jacket defines a chamber for receiving high temperature high pressure vapor. The conduit 54 connects the extraction port 36 to the jacket 70.

In the second embodiment, instead of reintroducing the extracted vapor directly into the expanding vapor stream, via injectors on the turbine body, the high temperature high pressure vapor extracted through the extraction port 36 is supplied to the annular chamber defined by the external jacket 70. Heat energy from the extracted vapor passes through the walls of the turbine to heat the vapor in contact with the turbine walls as the vapor moves along its expansion path. It is well-known that moisture forming during expansion has a tendency to concentrate along the perimeter walls of the path, due to centrifugal force throwing the droplets being formed in that direction. The location of the external jacket is therefore ideally situated to maximize the effectiveness of the heat transfer opportunity in delivering the jacket heat energy directly to the mass most in need of receiving it. A jacket condensate drain 72 provides a means for removing spent vapor from the jacket 70 after the heat transfer has been accomplished.

In each case it should be noted that the vapor being used to reheat the cooler, wetter vapor farther along the turbine expansion path originated within the same high temperature high pressure vapor flow 52 already being received by the turbine from the heat source 20. More specifically, reheat is being effected while the expanding vapor is in transit through the turbine 24, with no need to withdraw the turbine medium from the turbine for the purpose of adding additional heat energy along its cycle path.

As a variation on the embodiments shown in FIGS. 1 and 2, the steam being used to elevate the temperature of a cooler segment of the vapor path may be introduced directly from the external heat source through a bypass conduit. The bypass conduit is connected at one end to the heat source and at the other end to delivering means. In this embodiment, a portion of the steam generated by the heat source is directed through the bypass conduit to the manifold or jacket, depending upon the embodiment of delivering means, and thence delivered to the turbine. In either case, the majority of the heat source output continues to enter the turbine through the admission port 22.

Figure 3:
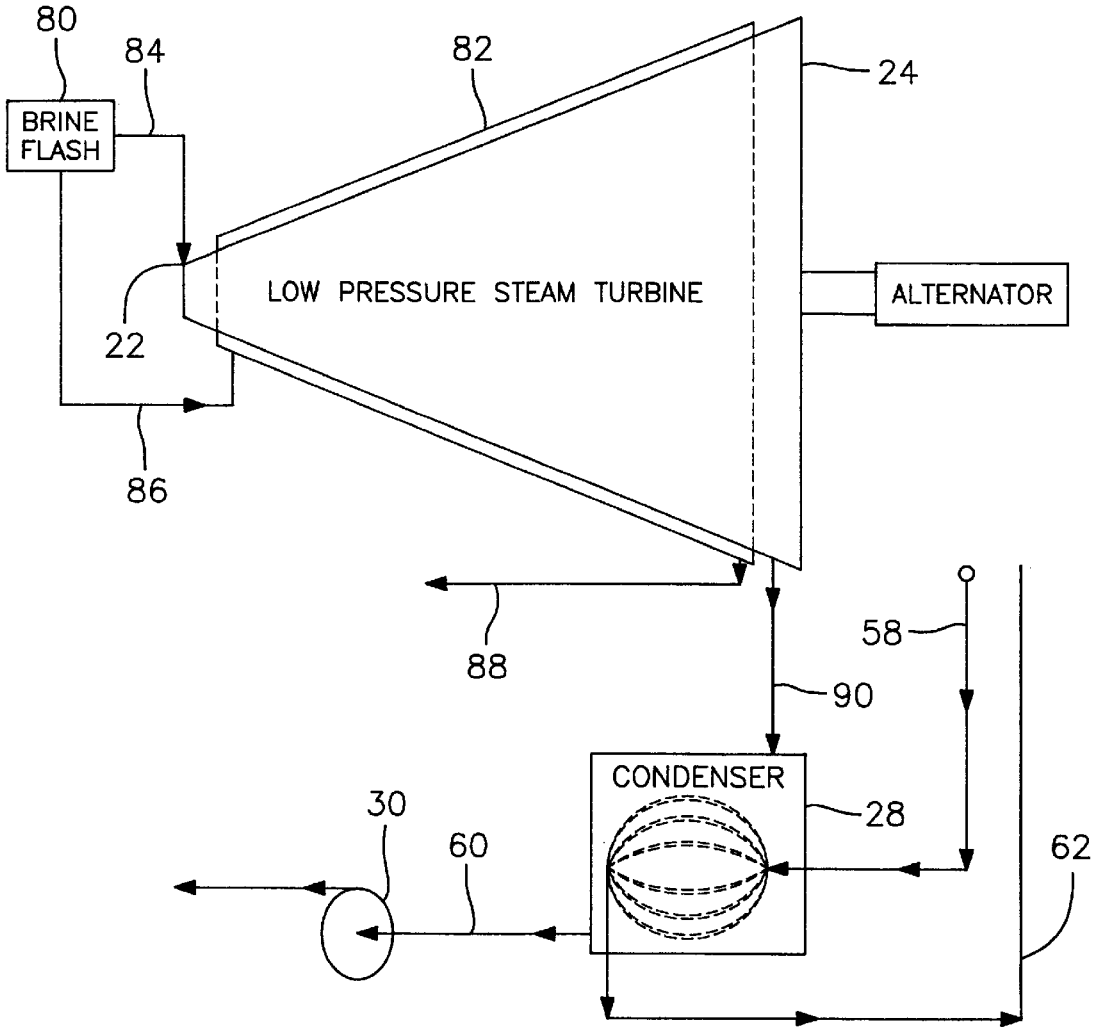
FIG. 3 illustrates a third embodiment of the present invention having a geothermal brine flash reheat steam turbine cycle.

FIG. 3 illustrates a third embodiment of the auto-reheat system. Means for directing is embodied as a conduit 86, coupled at one end to the heat source 80. Means for delivering is embodied as an annular jacket 82 surrounding an outer surface of the turbine in an area corresponding to at least part of the subsequent zone. Depending on the intended application of this embodiment, the jacket may extend nearly the entire length of the turbine body. The jacket 82 is connected to a second end of the conduit 86.

The embodiment of FIG. 3 represents a special application of the inventive concept which is made available when the steam mass flow being supplied to the turbine originates as a result of flashing a high pressure, high temperature liquid phase turbine medium at a reduced pressure to yield a vapor fraction suitable for expansion via a Rankine cycle turbine. Such a jacket arrangement would also permit use of steam or other hot fluid from an auxiliary process in the plant to supply supplemental heat input to the jacket to assist the power generation function, with no interruption to the continuous expansion process within the turbine.

As depicted in FIG. 3, a brine flash 80 provides the heat source. The brine flash produces saturated steam and liquid phase brine, both of which are, for example, at a temperature of 304° F. and a pressure of 72 psia. The saturated steam is conveyed to the turbine through a steam conduit 84 and is input to the turbine 24 through the admission port 22. The liquid phase brine is directed through the conduit 86 to the annular jacket 82 surrounding the turbine 24. By admitting the liquid phase brine into the annular jacket 82, the heat energy contained in the hot liquid residue from the flash continues to transfer elevated temperature heat energy to the expanding vapor phase medium in transit through the turbine body. As shown in the figure, in a geothermal application the jacket extends nearly the entire length of the turbine body; this is desirable in view of the already saturated condition of the entering vapor, as was just discussed. Through use of the jacket the liquid brine, instead of simply being a waste stream, provides valuable heat energy for eliminating or greatly reducing the occurrence of injurious wet vapor conditions as the vapor expands isentropically along the turbine cycle path. Again, the reheat is efficient as it is derived from a portion of the same hot fluid already being supplied to the turbine plant for power generation. After the residual heat brine fluid has supplied auxiliary heat through the jacket 82, the residual fluid is directed through a conduit 88 to brine reinjection wells.

As previously discussed, most geothermal brines contain dissolved minerals and other pollutants which impose a minimum temperature at which the brine liquid residue must be re-injected to avoid releasing the dissolved pollutants from the fluid and causing damaging deposits as the solutes separate from the liquid. However, this temperature is often significantly lower than the temperature of the brine residue; in the prior art this excess heat was wasted. With the current invention, by using the residual liquid phase brine left after the flash process to supply an annular jacket around the steam turbine with auxiliary reheat input, this excess heat energy is put to valuable use. Through use of the brine residue, not only can the damaging production of wet vapor conditions be prevented without sacrificing high temperature high pressure steam to supply the jacket, but the resulting heated vapor transiting the turbine path actually acquires more heat energy, available for conversion to output shaft power, than had been made available from the flashed steam vapor alone.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. An auto-reheat system for use with a Rankine cycle turbine engine having an expansion cycle, said turbine having an admission port to admit heat energy, obtained from a heat source, to a main path through the turbine, the heat energy entering said turbine embodied as high temperature high pressure vapor, said turbine equipped with the necessary blading and stages to permit isentropic expansion of the vapor therethrough, beginning through an entry zone adjacent the admission port, the entry zone containing high pressure high temperature vapor, through a subsequent zone containing lower temperature lower pressure vapor, to an exit port, the auto-reheat system comprising:

a conduit having a first end and a second end, the first end for receiving high temperature high pressure vapor originating from the heat source;

a manifold connected to the second end of said conduit; and a plurality of injectors located around a perimeter of the turbine and connected to said manifold, said plurality of injectors for injecting the high temperature high pressure vapor received from said conduit into the turbine in an area corresponding to the subsequent zone, the injected vapor increasing the temperature of expanding vapor within the subsequent zone and thereby reducing a volume of moisture condensing therein.

2. The auto-reheat system as set forth in claim 1, further comprising:

an extraction port, located on a side of the turbine and connected to the first end of said conduit, for extracting a portion of said high temperature high pressure vapor from the entry zone, the extracted portion of said high temperature high pressure vapor being input to the first end of said conduit.

3. The auto-reheat system as set forth in claim 1, wherein the first end of said conduit is connected to the heat source, for directing a portion of high temperature high pressure vapor produced by the heat source directly to said manifold.

4. An auto-reheat system for use with a Rankine cycle turbine engine having an expansion cycle, said turbine having an admission port to admit heat energy, obtained from a heat source, to a main path through the turbine, the heat energy entering said turbine embodied as high temperature high pressure vapor, said turbine equipped with the necessary blading and stages to permit isentropic expansion of the vapor therethrough, beginning through an entry zone adjacent the admission port, the entry zone containing high pressure high temperature vapor, through a subsequent zone containing lower temperature lower pressure vapor, to an exit port, the auto-reheat system comprising:

a conduit having a first end and a second end, the first end for receiving high temperature high pressure vapor originating from the heat source;

an annular jacket around an outer surface of the turbine in an area corresponding to at least part of the subsequent zone, said jacket connected to the second end of said conduit, said jacket defining an annular chamber for receiving high temperature high pressure vapor through said conduit, the high temperature high pressure vapor within the chamber acting, via heat transfer through the outer surface, to increase the temperature of expanding vapor within the subsequent zone and thereby reduce a volume of moisture condensing therein.

5. The auto-reheat system as set forth in claim 4, further comprising:

an extraction port, located on a side of the turbine and connected to the first end of said conduit, for extracting a portion of said high temperature high pressure vapor from the entry zone, the extracted portion of said high temperature high pressure vapor being input to the first end of said conduit.

6. The auto-reheat system as set forth in claim 4, wherein the first end of said conduit is connected to the heat source, for directing a portion of high temperature high pressure vapor produced by the heat source directly to said annular jacket.

7. An auto-reheat system for use with a Rankine cycle turbine engine having an expansion cycle, said turbine connected to a heat source, said turbine having an admission port to admit high temperature high pressure vapor obtained from the heat source, said heat source generating high temperature high pressure vapor and a hot liquid residue by flashing a high pressure high temperature liquid phase medium at a reduced pressure to yield a vapor fraction, said vapor fraction input to said admission port as the high temperature high pressure vapor, said turbine equipped with the necessary blading and stages to permit isentropic expansion of the vapor therethrough, the auto-reheat system comprising:

a conduit, coupled at a first end to said heat source, for conveying the hot liquid residue;

an annular jacket around an outer surface of the turbine, said jacket connected to a second end of said conduit, said jacket defining a chamber for receiving the hot liquid residue conveyed by said conduit, the hot liquid residue, acting via heat transfer through the outer surface, increasing the temperature of the vapor expanding through the turbine and thereby reducing a volume of moisture condensing therein.

8. The auto-reheat system as set forth in claim 7, wherein the high pressure high temperature liquid phase medium is a pressurized hot geothermal fluid from a well field, and wherein the hot liquid residue, after supplying auxiliary heat to the turbine, is returned to the well field at a temperature and pressure that allow dissolved geothermal brine solutes to remain in solution.

9. The auto-reheat system as set forth in claim 1, wherein the heat energy obtained from the heat source is delivered to the entry zone and to the subsequent zone nearly concurrently.

10. The auto-reheat system as set forth in claim 4, wherein the heat energy obtained from the heat source is delivered to the entry zone and to the subsequent zone nearly concurrently.

11. The auto-reheat system as set forth in claim 7, wherein the hot liquid residue is conveyed to said jacket nearly concurrently with delivery of said high temperature high pressure vapor to said admission port.

* * * * *